US006739955B2

(12) United States Patent
Skrovan

(10) Patent No.: US 6,739,955 B2
(45) **Date of Patent: *May 25, 2004**

(54) APPARATUS AND METHODS FOR CONDITIONING POLISHING PADS IN MECHANICAL AND/OR CHEMICAL-MECHANICAL PLANARIZATION OF MICROELECTRONIC-DEVICE SUBSTRATE ASSEMBLIES

(75) Inventor: John Skrovan, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 303 days.

This patent is subject to a terminal disclaimer.

(21) Appl. No.: 09/813,433

(22) Filed: Mar. 20, 2001

(65) Prior Publication Data

US 2001/0019938 A1 Sep. 6, 2001

Related U.S. Application Data

(63) Continuation of application No. 09/229,487, filed on Jan. 13, 1999, now Pat. No. 6,203,413.

(51) Int. Cl.[7] ..... B24B 53/00
(52) U.S. Cl. ..... 451/72; 451/287; 451/288
(58) Field of Search ..... 451/72, 287, 288, 451/443, 444

(56) References Cited

U.S. PATENT DOCUMENTS 3,823,515 A * 7/1974 Coes, Jr. ..... 51/322
4,361,987 A 12/1982 Lapsker ..... 51/90
6,033,290 A * 3/2000 Gurusamy et al. ..... 451/56
6,203,413 B1 * 3/2001 Skrovan ..... 451/72
6,264,536 B1 7/2001 Crevasse et al. ..... 451/41

* cited by examiner

*Primary Examiner*—Allen Ostrager
*Assistant Examiner*—William Hong
(74) *Attorney, Agent, or Firm*—Dorsey & Whitney LLP

(57) ABSTRACT

Conditioning systems and methods for conditioning polishing pads used in mechanical and chemical-mechanical planarization of microelectronic-device substrate assemblies. In one aspect of the invention, a conditioning system includes a conditioning element or conditioning member having a conditioning face configured to engage a polishing pad. The conditioning face preferably includes a bonding medium covering at least a portion of the conditioning face and a plurality of conditioning particles attached to the bonding medium. The conditioning system also includes a corrosion-inhibiting unit that can be coupled to the conditioning element or a liquid on the polishing pad. The corrosion-inhibiting unit retards corrosion of the bonding medium in the presence of chemicals on the polishing pad that would otherwise corrode the bonding medium. For example, the corrosion-inhibiting unit can be a DC power source coupled to the conditioning element and the polishing pad to impart an electrical potential between the conditioning element and the polishing pad that retards corrosion of the bonding medium and/or other components of the conditioning element.

37 Claims, 3 Drawing Sheets

APPARATUS AND METHODS FOR CONDITIONING POLISHING PADS IN MECHANICAL AND/OR CHEMICAL-MECHANICAL PLANARIZATION OF MICROELECTRONIC-DEVICE SUBSTRATE ASSEMBLIES

CROSS-REFERENCE TO RELATED APPLICATION

This application is a continuation of U.S. patent application Ser. No. 09/229,487, filed Jan. 13, 1999 now Pat. No. 6,203,413.

TECHNICAL FIELD

The present invention relates to conditioning polishing pads used in mechanical and/or chemical-mechanical planarization of microelectronic-device substrate assemblies. More particularly, the invention relates to retarding deterioration of conditioning elements and reducing contamination of polishing pads.

BACKGROUND OF THE INVENTION

Mechanical and chemical-mechanical planarizing processes (collectively "CMP") are used in the manufacturing of microelectronic devices for forming a flat surface on semiconductor wafers, field emission displays and many other microelectronic-device substrate assemblies. FIG. 1 schematically illustrates a planarizing machine 10 with a circular platen or table 20, a first carrier assembly 30, a polishing pad 40 having a planarizing surface 42, and a planarizing fluid 44 on the planarizing surface 42. The planarizing machine 10 may also have an under-pad 25 attached to an upper surface 22 of the table 20 for supporting the polishing pad 40. In many planarizing machines, a drive assembly 26 rotates (arrow A) and/or reciprocates (arrow B) the table 20 to move the polishing pad 40 during planarization.

The first carrier assembly 30 controls and protects a substrate assembly 12 during planarization. The first carrier assembly 30 typically has a carrier head or substrate holder 32 with a pad 34 that holds the substrate 12 to the carrier head 32. A drive assembly 36 typically rotates and/or translates the carrier head 32 (arrows C and D, respectively). The carrier head 32, however, may be a weighted, free-floating disk (not shown) that slides over the polishing pad 40.

The polishing pad 40 and the planarizing solution 44 define a planarizing medium that mechanically and/or chemically-mechanically removes material from the surface of the substrate assembly 12. The planarizing machine 10 can use a fixed-abrasive polishing pad having a plurality of abrasive particles fixedly bonded to a suspension material. The planarizing solutions 44 used with fixed-abrasive pads are generally "clean solutions" without abrasive particles because an abrasive slurry may ruin the abrasive surface of fixed-abrasive pads. In other applications, the polishing pad 40 may be a nonabrasive pad composed of a polymeric material (e.g., polyurethane), a resin, or other suitable materials without abrasive particles. The planarizing solutions 44 used with nonabrasive polishing pads are typically "slurries" that contain abrasive particles.

CMP processes should consistently and accurately produce a uniformly planar surface on the substrate assembly 12 to enable precise fabrication of circuits and photo-patterns. For example, during the fabrication of transistors, contacts, interconnects and other components, many substrate assemblies develop large "step heights" that create a highly topographic surface across the substrate assembly 12. To enable the fabrication of integrated circuits with high densities of components, it is necessary to produce a highly planar surface at several stages of processing the substrate assembly 12 because non-planar surfaces significantly increase the difficulty of forming submicron features. For example, it is difficult to accurately focus photo-patterns to within tolerances of 0.1 $\mu$m on nonplanar surfaces because submicron photolithographic equipment generally has a very limited depth of field. Thus, CMP processes often transform a topographical surface into a highly uniform, planar surface.

In the competitive semiconductor industry, it is also highly desirable to have a high yield of operable devices after CMP processing. CMP processes should thus quickly remove material from the substrate assembly 12 to form a uniformly planar surface at a desired endpoint. For example, when a conductive layer on the substrate assembly 12 is under-planarized in the formation of contacts or interconnects, many of these components may not be electrically isolated from one another because undesirable portions of the conductive layer may remain on the substrate assembly 12. Additionally, when a substrate assembly 12 is over-planarized, components below the desired endpoint may be damaged or completely destroyed. Thus, to provide a high yield of operable microelectronic devices, CMP processes should quickly remove material until the desired endpoint is reached.

To provide consistent results and produce planar surfaces, one aspect of CMP processing is maintaining the condition of the planarizing surface 42 on the polishing pad 40. The condition of the planarizing surface 42 changes because residual matter collects on the planarizing surface 42 of the polishing pad 40. The residual matter, for example, can be from the substrate assembly 12, the planarizing solution 44 and/or the polishing pad 40. In certain applications, residual matter from the substrate assembly 12 can even glaze over sections of the planarizing surface 42 (e.g., planarizing doped silicon dioxide layers). The substrate assemblies can also wear depressions into the planarizing surface 42 that create a non-planar planarizing surface. In many CMP applications, therefore, polishing pads are accordingly "conditioned" periodically to bring the planarizing surface into a desired condition for planarizing the substrate assemblies.

To condition the planarizing surface 42, the planarizing machine 10 can include a conditioning system 50 that rubs an abrasive conditioning stone 60 against the planarizing surface 42 of the polishing pad 40 between planarizing cycles. The conditioning stone 60 typically includes a metal plate 62, a layer of nickel 64 covering the bottom surface of the metal plate 62, and a plurality of diamond particles 66 embedded in the nickel layer 64. The metal plate 62 is attached to a second carrier assembly 70 that presses the diamond particles 66 against the polishing pad 40 and sweeps the conditioning stone over the planarizing surface 42.

One problem with conventional conditioning stones 60 is that they wear out and can adversely affect the conditioning of the polishing pad 40. Conventional conditioning stones, for example, may contaminate the planarizing surface 42 with material from the nickel layer 64 or the diamond particles 66. The nickel layer 64 may wear during the conditioning cycle, which leaves residual nickel on the planarizing surface 42 and reduces the amount of nickel holding the diamond particles 66 to the plate 62. The diamond particles 66 can thus break away from the nickel layer 64 and remain on the planarizing surface 42 after the conditioning cycle. The residual materials from the conventional conditioning stones 60 that remain on the planarizing surface 42 may produce defects on the substrate assemblies 12 during the planarizing cycle. Moreover, the loss of diamond particles 66 from the conditioning stones 60 changes the abrasiveness of the conditioning stones 60, which can cause inconsistent conditioning of the planarizing surface 42. Thus, there is a need to improve conditioning systems and processes to condition polishing pads 40.

SUMMARY OF THE INVENTION

The present invention is directed toward conditioning systems and methods for conditioning polishing pads used in mechanical and chemical-mechanical planarization of microelectronic-device substrate assemblies. In one aspect of the invention, a conditioning system includes a conditioning element or conditioning member having a conditioning face configured to engage a polishing pad. The conditioning face preferably includes a bonding medium covering at least a portion of the conditioning face and a plurality of conditioning particles attached to the bonding medium. The conditioning system also includes a corrosion-inhibiting unit that can be coupled to the conditioning element and/or a liquid on the polishing pad. The corrosion-inhibiting unit preferably retards corrosion of the bonding medium in the presence of chemicals on the polishing pad that would otherwise corrode the bonding medium. For example, the corrosion-inhibiting unit can be a DC power source coupled to the conditioning element to impart an electrical potential between the conditioning element and the polishing pad that retards corrosion of the bonding medium and/or other components of the conditioning element.

The conditioning system also preferably includes an arm to carry the conditioning element and an actuator coupled to the arm to selectively position the conditioning element with respect to the planarizing surface of the polishing pad. In operation, the actuator drives the arm to press the conditioning face of the conditioning element against the planarizing surface of the polishing pad, and then the conditioning element and/or the polishing pad move relative to one another to rub the conditioning element against the planarizing surface. As the conditioning element engages the polishing pad, the corrosion-inhibiting unit preferably applies an electrical potential to the conditioning element that retards corrosion of the conditioning element in the presence of the chemicals on the polishing pad.

The polishing pad is preferably conditioned during a discreet conditioning cycle between planarizing cycles of separate substrate assemblies. As such, another aspect of the invention is planarizing substrate assemblies by first removing material from the substrate assemblies using the polishing pad in the presence of a planarizing solution, and then conditioning the planarizing surface of the polishing pad by rubbing the conditioning element against the planarizing surface while retarding corrosion of the conditioning element.

DETAILED DESCRIPTION OF THE INVENTION

The present invention is directed toward conditioning polishing pads used in mechanical and/or chemical-mechanical planarization of substrate assemblies. Many specific details of certain embodiments of the invention are set forth in the following description, and in FIGS. 2 and 3, to provide a thorough understanding of such embodiments. One skilled in the art however, will understand that the present invention may have additional embodiments, or that the invention may be practiced without several of the details described in the following description.

Figure 1:
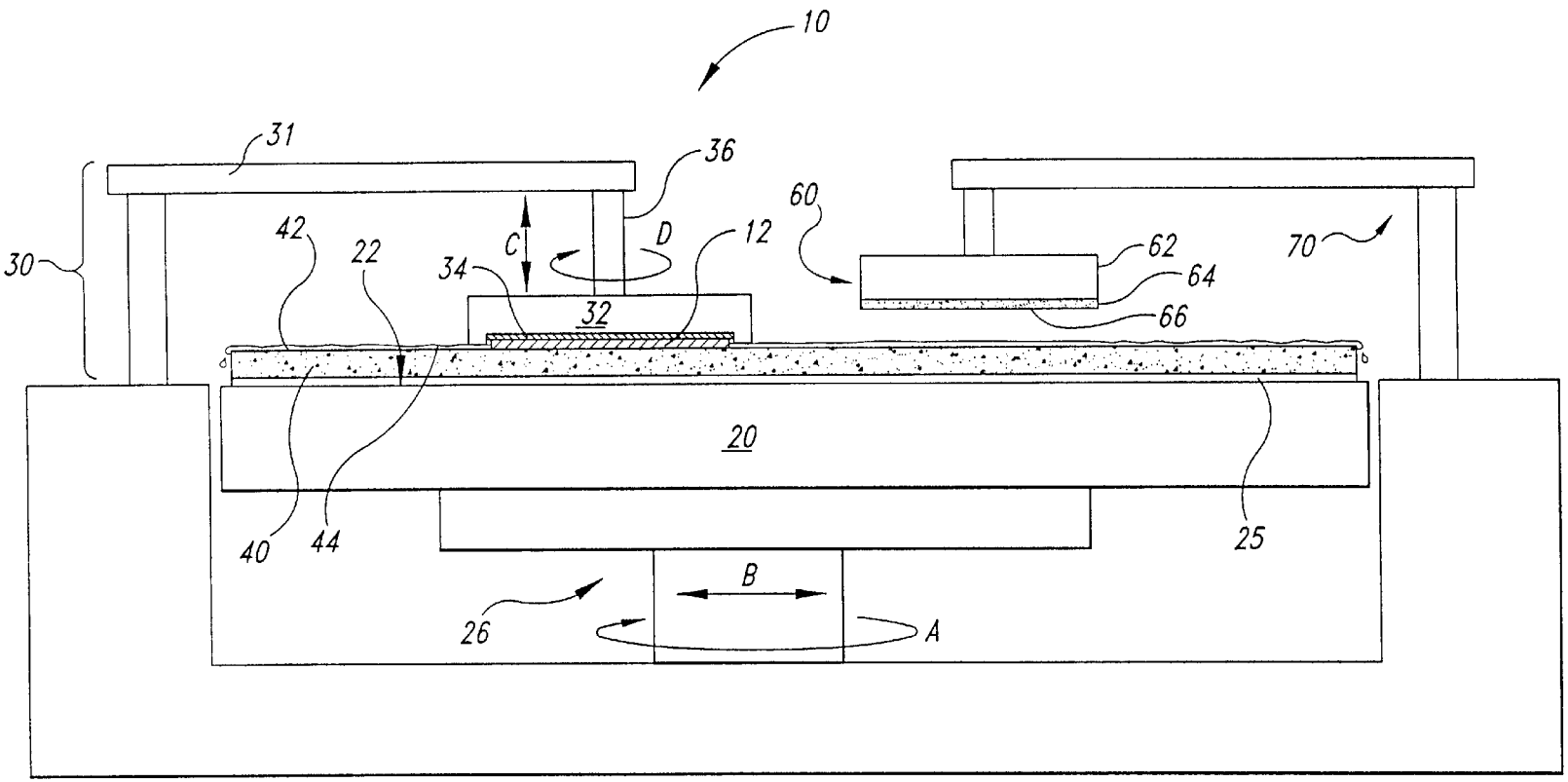
Fig. 1 (Prior Art)
FIG. 1 is a schematic cross-sectional view of a planarizing machine with a conditioning system in accordance with the prior art.
Figure 2:
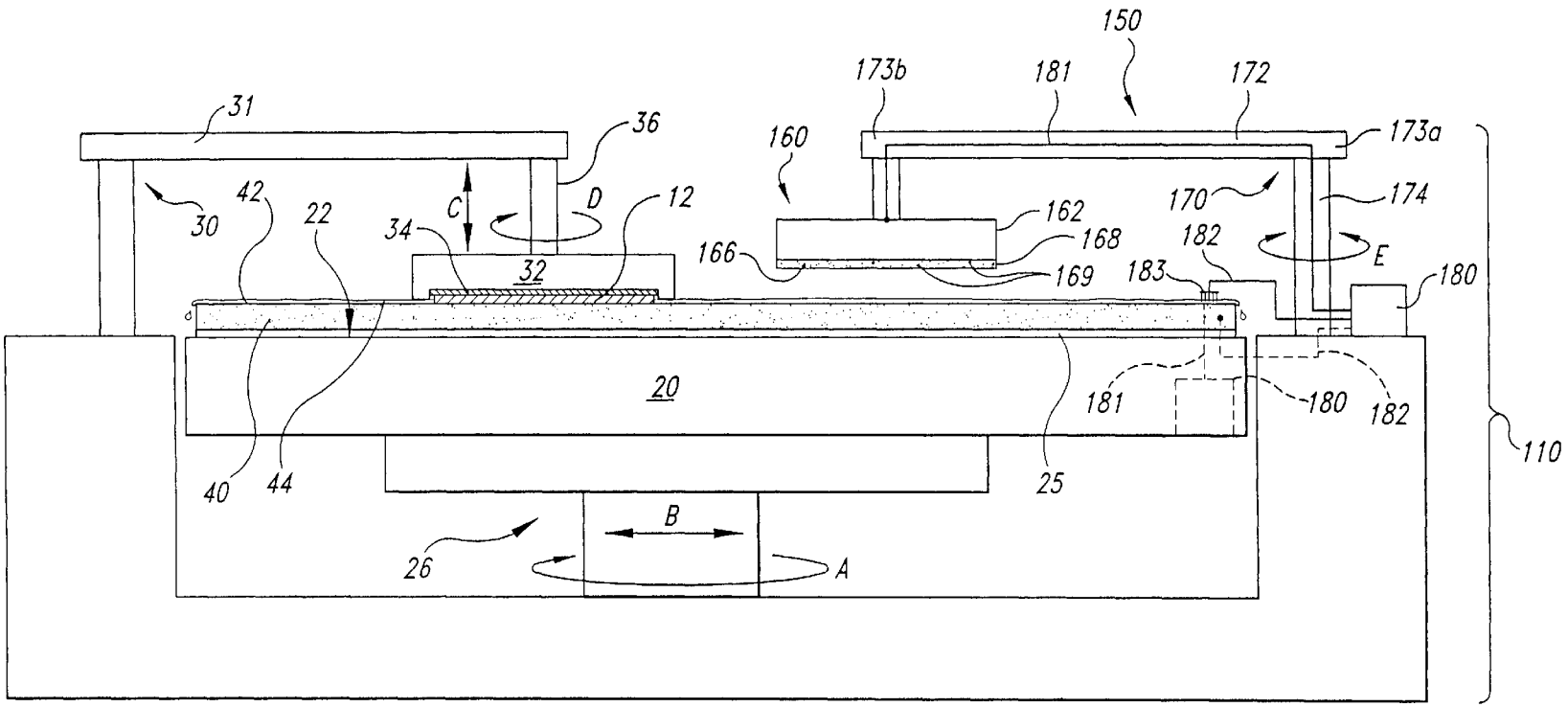
FIG. 2 is a schematic cross-sectional view of a planarizing machine including a conditioning system in accordance with an embodiment of the invention.

FIG. 2 is a schematic cross-sectional view of a planarizing machine 110 including a conditioning system 150 in accordance with an embodiment of the invention. The planarizing machine 110 generally has a table 20, a first carrier assembly 30, and a polishing pad 40 for planarizing a substrate assembly 12. The table 20, the carrier assembly 30, and the polishing pad 40 of the planarizing machine 110 can be similar to those described above with respect to FIG. 1. To planarize the substrate assembly 12, the first carrier assembly 30 presses the substrate 12 against the planarizing surface 42 of the polishing pad 40 in the presence of a planarizing solution 44. After the substrate assembly 12 has been planarized, the conditioning system 150 preferably restores the planarizing surface 42 of the polishing pad 40 to a desired condition, as explained in detail below.

The conditioning system 150 preferably includes a conditioning element 160, a second carrier assembly 170 to move the conditioning element 160, and a corrosion-inhibiting unit 180 coupled to the conditioning element 160. The conditioning system 150 generally operates independently from the first carrier assembly 30 to provide independent control of a planarizing cycle of the substrate assembly 12 and a conditioning cycle of the polishing pad 40. The conditioning system 150, for example, generally operates between each planarizing cycle of a run of substrate assemblies. The conditioning system 150 may alternatively operate during the planarizing cycles of the substrate assemblies to reduce downtime between planarizing cycles.

Figure 3:
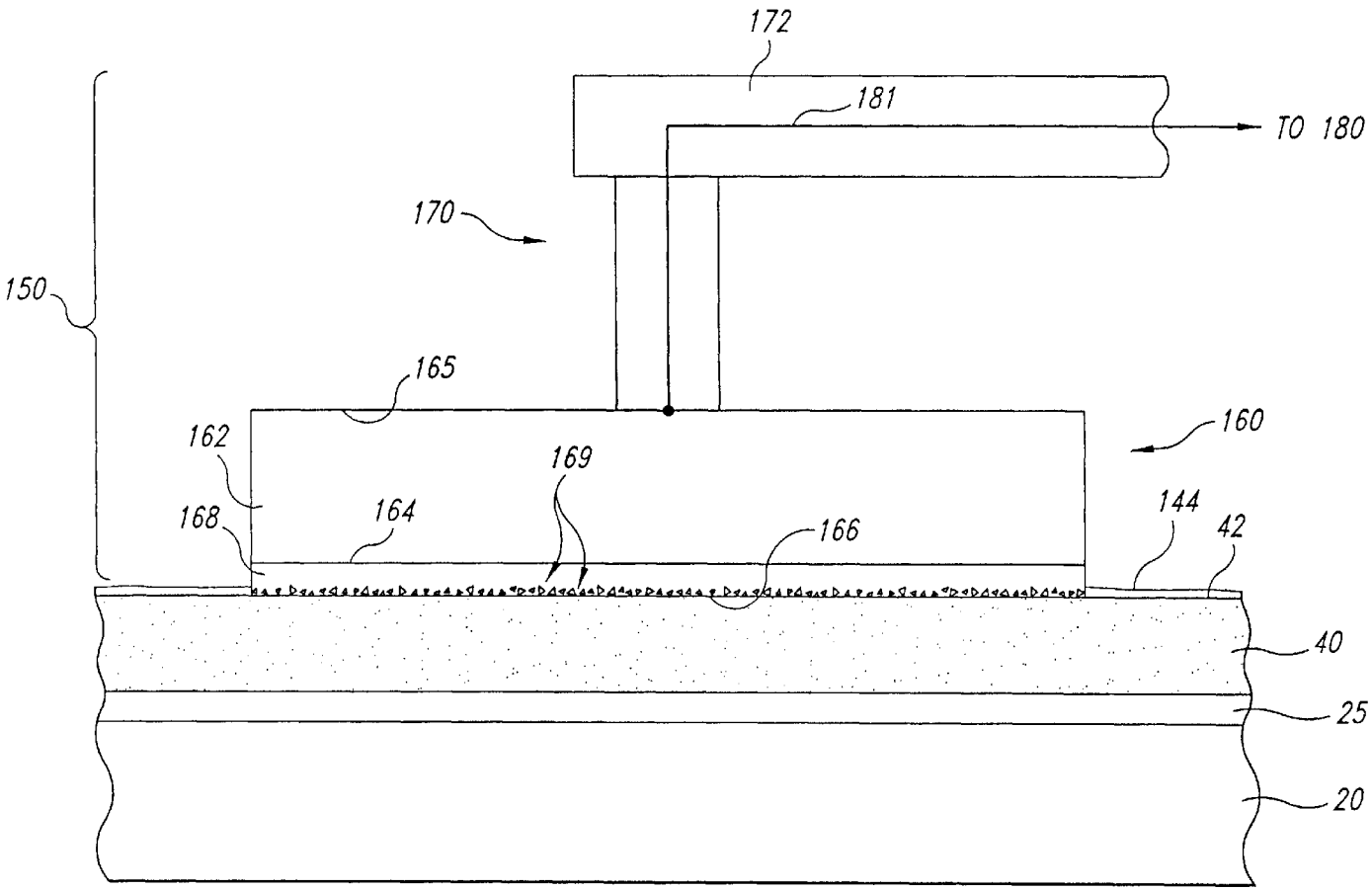
FIG. 3 is a schematic cross-sectional view partially illustrating the conditioning system of FIG. 2.

FIG. 3 is a schematic cross-sectional view illustrating the conditioning element 160 of FIG. 2 in greater detail. Referring to FIGS. 2 and 3 together, the conditioning element 160 includes a body 162 having a frontside 164 and a backside 165, a bonding medium 168 covering at least a portion of the frontside 164, and a plurality of conditioning particles 169 attached to the bonding medium 168. The bonding medium 168 can be composed of a material that bonds to both the frontside 164 of the conditioning element 160 and the conditioning particles 169. The bonding medium 168, for example, can be a layer of nickel. The conditioning particles 169 are preferably abrasive particles, such as small diamond particles or other suitable abrasive particles. The bonding medium 168 and the conditioning particles 169 together define a conditioning face 166 that is configured to engage the planarizing surface 42 of the polishing pad 40 during a conditioning cycle.

The second carrier assembly 170 preferably includes an arm 172 and an actuator 174 (FIG. 2). The arm 172 generally has a first end 173*a* (FIG. 2) coupled to the actuator 174 and a second end 173*b* (FIG. 2) projecting from the first end 173*a*. The conditioning element 160 is coupled to the arm 172. The conditioning element 160 can be fixedly attached to the second end 173*b* of the arm 172, or the conditioning element 160 can be movably attached to the arm 172 to translate along the arm between the first and second ends 173*a* and 173*b*. The actuator 174 moves the arm 172 up/down with respect to the polishing pad 40 to engage/disengage the conditioning element 160 with the planarizing surface 42 of the polishing pad 40. The actuator 174 may also rotate the arm 172 (arrow E) to sweep the conditioning element 160 across the planarizing surface 42. The second carrier assembly 170 accordingly rubs the conditioning element 160 against the planarizing surface 42 to abrade the planarizing surface 42 and/or remove residual materials from the polishing pad 40. When the conditioning system 150 operates between planarizing cycles, the planarizing surface 42 is preferably flushed with deionized water 144 (FIG. 3) to remove residual matter and the used planarizing solution 44 (FIG. 2) from the pad 40.

The corrosion-inhibiting unit 180 is preferably coupled to the conditioning element 160 and to the liquid on the planarizing surface 42. The corrosion-inhibiting unit 180 at least substantially inhibits or otherwise retards corrosion of the bonding medium 168 and/or the body 162 of the conditioning element 160 caused by residual chemicals from the planarizing solution 44 or other sources that remain on the polishing pad 40 during the conditioning cycle.

In one embodiment, the corrosion-inhibiting unit 180 is an electrical unit that electrically biases the conditioning element 160 and the liquid on the polishing pad (e.g., the planarizing solution 44 or the deionized water 144) with an electrical potential. The corrosion-inhibiting unit 180 is preferably a DC power source that imparts an electrical potential between the conditioning element 160 and the liquid on the planarizing surface 42 to retard corrosion of the conditioning element 160. For example, the corrosion-inhibiting unit 180 can be a battery or other power source having one terminal coupled to the conditioning element 160 by a first conductive line 181 and the other terminal coupled to the liquid on the planarizing surface by a second conductive line 182. The second conductive line 182 can be coupled directly to the liquid by a brush 183 contacting the liquid on the planarizing surface 42, or the conductive line 182 can be coupled to the pad 40 (shown in phantom by line 182). In still other embodiments (shown in phantom), the corrosion-inhibiting unit 180 is mounted to the planarizing table 20 such that one terminal is coupled to the pad 40 or the liquid on the planarizing surface 42, and the other terminal is coupled to the conditioning element (not shown). The electrical contacts between the corrosion-inhibiting unit 180 and both the conditioning element 160 and the liquid on the planarizing surface are within the knowledge of a person skilled in the electrical arts. Thus, in addition to abrading or otherwise removing material from the polishing pad 40 with the conditioning element 160, the conditioning system 150 also retards corrosion of the conditioning element 160 in the presence of chemicals from the planarizing solution 44 and/or other sources that contact the conditioning element 160.

The embodiment of the conditioning system 150 shown in FIGS. 2 and 3 is expected to be particularly useful for conditioning polishing pads used in the planarization of metal surfaces on substrate assemblies. In one application, for example, the substrate assembly 12 can have a metal cover layer (e.g., aluminum) over an underlying dielectric layer. The metal cover layer typically fills a plurality of holes and/or trenches in the underlying dielectric layer. A plurality of contacts and/or damascene lines are thus formed by planarizing the metal layer to the top of the underlying dielectric layer. The metal cover layer is preferably planarized with a planarizing solution containing chemicals that oxidize and/or dissolve the particular type of metal to chemically remove a portion of the metal layer. As a result, any such chemicals from the conditioning solution 44 remaining on the planarizing surface 42 will aggressively corrode a bonding medium 168 composed of nickel or another metal. The corrosion-inhibiting unit 180, however, protects metal bonding mediums by electrically biasing the bonding medium 168 to retard electro-chemical erosion.

In a preferred embodiment in which the bonding medium 168 is composed of nickel and the planarizing solution 44 contains chemicals to oxidize and/or dissolve an aluminum metal cover layer, the corrosion-inhibiting unit is preferably a DC power source that applies a voltage potential of −0.1 V to −12 V to the bonding medium 168. For example, when the body 162 is a metal plate, the negative terminal of a 6 V battery can be coupled to the body 162 to apply a −6 V potential to the bonding medium 168. By applying an appropriate voltage potential to a bonding medium 168, the conditioning system 150 reduces corrosion of the metal bonding medium 168 during conditioning cycles.

The embodiment of the planarizing machine 110 with the conditioning system 150 shown in FIGS. 2 and 3 is expected to increase the operating life of conditioning elements and reduce contamination of the polishing pads. One aspect of this embodiment of the invention is that the bonding medium 168 remains substantially intact on the conditioning element 160 over a large number of conditioning cycles because the corrosion-inhibiting unit 180 protects the conditioning element 160 from electrochemical erosion. The conditioning system 150 accordingly inhibits the bonding medium 168 from deteriorating and contaminating the planarizing surface 42 of the pad 40. Moreover, because the corrosion-inhibiting unit 180 reduces deterioration of the bonding medium 168, the conditioning system 150 also reduces the number of conditioning particles 169 that break away from the conditioning element 160. The conditioning system 150 is thus expected to maintain the abrasiveness of the conditioning element 160 and reduce defects on the substrate assemblies caused by detached conditioning particles 169 remaining on the polishing pad 40. Therefore, compared to conventional conditioning systems, the embodiment of the conditioning system 150 is expected to increase the operating life of conditioning elements and reduce contamination of the polishing pad.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A system for conditioning a chemical-mechanical planarization polishing pad, comprising:

a conditioning element having a conditioning face configured to engage the polishing pad; and an electrical potential corrosion-inhibiting element that is electrically coupled to the conditioning element and a liquid disposed on the polishing pad.

2. The conditioning system of claim 1 wherein the corrosion-inhibiting element comprises a power source having one terminal coupled to the conditioning element and another terminal coupled to the polishing pad.

3. The conditioning system of claim 1 wherein the corrosion-inhibiting element comprises a power source, a first conductive line connecting one terminal of the power source to the conditioning element, and a second conductive line connecting another terminal of the power source to a brush that engages the liquid.

4. The conditioning system of claim 1 wherein the conditioning face comprises a bonding medium and a plurality of conditioning particles attached to the bonding medium, and the corrosion-inhibiting unit comprises an electrical biasing unit coupled to the conditioning element and that imparts an electrical potential to the bonding medium.

5. The conditioning system of claim 4 herein the conditioning element comprises a metal plate and the electrical biasing unit comprises a DC power source coupled to the metal plate.

6. The conditioning system of claim 5 wherein the DC power source comprises a battery.

7. The conditioning system of claim 4 wherein the conditioning element comprises a metal plate, the bonding medium comprises a nickel layer, and the conditioning particles comprises abrasive diamond particles.

8. The conditioning system of claim 7 wherein the electrical biasing unit comprises a DC power source coupled to the metal plate.

9. The conditioning system of claim 8 werein the DC power source provides a potential of −0.1 V to −12.0 V to the metal plate.

10. A system for conditioning a chemical-mechanical planarization polishing pad, comprising:

a conditioning member including a body having a backside facing away from a polishing pad and a frontside facing toward the polishing pad, a layer of bonding material covering a portion of the frontside, and a plurality of conditioning particles attached to the bonding material; and an electrical corrosion retarder coupled to the conditioning member and to a liquid on the polishing pad.

11. The conditioning system of claim 10 wherein the electrical corrosion retarder comprises an electrical biasing unit coupled to the conditioning member to impart an electrical potential to the bonding material.

12. The conditioning system of claim 11 wherein body of the conditioning member comprises a metal plate and the electrical biasing unit comprises a DC power source coupled to the metal plate.

13. The conditioning system of claim 12, wherein the DC power source comprises a battery.

14. The conditioning system of claim 10 wherein:

the body of the conditioning member comprises a metal plate, the bonding material comprises a nickel layer on the frontside of the metal plate, and the conditioning particles comprises diamond particles embedded in the nickel layer; and the electrical corrosion retarder comprises an electrical biasing unit coupled to the metal plate that imparts an electrical potential to the bonding material through the metal plate.

15. The conditioning system of claim 14 wherein the electrical biasing unit comprises a DC power source coupled to the metal plate.

16. The conditioning system of claim 15 wherein the DC power source provides a potential of −0.1 V to −12.0 V to the metal plate.

17. A system for conditioning a chemical-mechanical planarization polishing pad, comprising:

an arm attached to an actuator at a first position on the arm and to a conditioning element at a second position on the arm, the conditioning element including a plate having a conditioning face configured to engage a polishing pad, the conditioning face including a bonding medium and a plurality of conditioning particles attached to the bonding medium; and an electrical corrosion-inhibiting unit coupled to the conditioning element and to a liquid on the polishing pad.

18. The conditioning system of claim 17 wherein the electrical corrosion-inhibiting unit comprises an electrical biasing unit coupled to the conditioning element to impart an electrical potential to the bonding medium.

19. The conditioning system of claim 18 wherein the conditioning element comprises a metal plate and the electrical biasing unit comprises a DC power source coupled to the metal plate.

20. The conditioning system of claim 19 wherein the DC power source comprises a battery.

21. The conditioning system of claim 17 wherein:

the conditioning element comprises a metal plate, the bonding medium comprises a nickel layer, and the conditioning particles comprises abrasive diamond particles; and the electrical corrosion-inhibiting unit comprises an electrical biasing unit coupled to the conditioning element to impart an electrical potential to the bonding medium.

22. The conditioning system of claim 21 wherein the electrical biasing unit comprises a DC power source coupled to the metal plate.

23. The conditioning system of claim 22 wherein the DC power source provides a potential of −0.1 V to −12.0 V to the metal plate.

24. A planarizing machine for mechanical and chemical-mechanical planarization of microelectronic-device substrate assemblies, comprising:

a table having a support surface;

a polishing pad positioned on the support surface;

a carrier assembly having a carrier head configured to hold a substrate assembly and a drive assembly configured to press the substrate assembly against the polishing pad, at least one of the carrier head or the polishing pad being moveable with respect to the other; and a conditioning system including a conditioning element and an electrical corrosion-inhibiting element, the conditioning element having a conditioning face configured to engage the polishing pad, the conditioning face including a bonding medium and a plurality of conditioning particles attached to the bonding medium, and the electrical corrosion-inhibiting element being coupled to the conditioning element and a liquid disposed on the polishing pad.

25. The planarizing machine of claim 24 wherein the electrical corrosion-inhibiting unit comprises an electrical biasing unit coupled to the conditioning element to impart an electrical potential to the bonding medium.

26. The planarizing machine of claim 25 wherein the conditioning element comprises a metal plate and the electrical biasing unit comprises a DC power source coupled to the metal plate.

27. The planarizing machine of claim 26 wherein the DC power source comprises a battery.

28. The planarizing machine of claim 24 wherein:

the conditioning element comprises a metal plate, the bonding medium comprises a nickel layer, and the conditioning particles comprises abrasive diamond particles; and the electrical corrosion-inhibiting unit comprises an electrical biasing unit coupled to the conditioning element to impart an electrical potential to the bonding medium.

29. The planarizing machine of claim 28 wherein the conditioning element comprises a metal plate and the electrical biasing unit comprises a DC power source coupled to the metal plate.

30. The planarizing machine of claim 29 wherein the DC power source provides a potential of −0.1 V to −12.0 V to the metal plate.

31. A planarizing machine for mechanical and chemical-mechanical planarization of microelectronic-device substrate assemblies, comprising:

a table having a support surface;

a polishing pad positioned on the support surface;

a carrier assembly having a carrier head configured to hold a substrate assembly and a drive assembly to selectively press the substrate assembly against the polishing pad, at least one of the carrier head or the polishing pad being moveable with respect to the other;

a conditioning member positionable over the polishing pad, the conditioning member including a body having a backside that faces away from a polishing pad and a frontside that faces toward the polishing pad, a layer of bonding material covering at least a portion of the frontside, and a plurality of conditioning particles attached to the layer of bonding material; and an electrical corrosion retarder coupled to the conditioning member that inhibits corrosion of the layer of bonding material in the presence of chemicals on the polishing pad that would otherwise corrode the layer of bonding material.

32. The planarizing machine of claim 31 wherein the electrical corrosion retarder comprises an electrical biasing unit coupled to the conditioning member to impart an electrical potential to the bonding material.

33. The planarizing machine of claim 32 wherein the conditioning member comprises a metal plate and the electrical biasing unit comprises a DC power source the metal plate.

34. The planarizing machine of claim 33 wherein the DC power source is connected to the body of the conditioning member.

35. The planarizing machine of claim 31 wherein:

the body of the conditioning member comprises a metal plate, the bonding material comprises a nickel layer on the frontside of the metal plate, and the conditioning particles comprises diamond particles embedded in the nickel layer; and the electrical corrosion retarder comprises an electrical biasing unit coupled to the metal plate to impart an electrical potential to the bonding material through the metal plate.

36. The planarizing machine of claim 35 wherein the electrical biasing unit comprises a DC power source coupled to the metal plate.

37. The planarizing machine of claim 36 wherein the DC power source provides a potential of −0.1 V to −12.0 V to the metal plate.

* * * * *

UNITED STATES PATENT AND TRADEMARK OFFICE

CERTIFICATE OF CORRECTION

PATENT NO. : 6,739,955 B2
DATED : May 25, 2004
INVENTOR(S) : John Skrovan

It is certified that error appears in the above-identified patent and that said Letters Patent is hereby corrected as shown below:

Title page,
Item [56], References Cited, U.S. PATENT DOCUMENTS, insert
-- 6,265,781 B1 7/2001 Andreas…….257/765
6,313,038 B1 11/2001 Chopra et al…..438/692 --

Column 6,
Line 31, "from electrochemical" should read -- from electro-chemical --

Column 7,
Lines 20 and 52, "particles comprises" should read -- particles comprise --
Line 41, "wherein body" should read -- wherein the body --

Column 8,
Lines 21 and 66, "particles comprises" should read -- particles comprise --

Column 10,
Line 9, "power source the metal" should read -- power source coupled to the metal --
Line 18, "particles comprises" should read -- particles comprise --

Signed and Sealed this

Nineteenth Day of April, 2005

JON W. DUDAS
*Director of the United States Patent and Trademark Office*